US008464471B2

(12) United States Patent
Bertram

(10) Patent No.: US 8,464,471 B2
(45) Date of Patent: Jun. 18, 2013

(54) PANEL MOVEMENT SYSTEM

(76) Inventor: Graeme Owen Bertram, Hamilton (NZ)

( * ) Notice: Subject to any disclaimer, the term of this patent is extended or adjusted under 35 U.S.C. 154(b) by 178 days.

(21) Appl. No.: 12/989,945

(22) PCT Filed: Apr. 17, 2009

(86) PCT No.: PCT/NZ2009/000060
§ 371 (c)(1),
(2), (4) Date: Oct. 27, 2010

(87) PCT Pub. No.: WO2009/134148
PCT Pub. Date: Nov. 5, 2009

(65) Prior Publication Data

US 2011/0126476 A1 Jun. 2, 2011

(30) Foreign Application Priority Data

Apr. 28, 2008 (NZ) ..... 567796

(51) Int. Cl.
*E05F 1/16* (2006.01)

(52) U.S. Cl.
USPC ..... 49/372; 49/286; 49/379

(58) Field of Classification Search
USPC . 49/372, 323, 379, 279, 286, 449; 312/138.1, 312/139, 319.1
See application file for complete search history.

(56) References Cited

U.S. PATENT DOCUMENTS

| | | | | |
|---|---|---|---|---|
| 4,249,761 | A * | 2/1981 | Nishimura | 292/251.5 |
| 5,657,969 | A * | 8/1997 | Bivens | 267/64.12 |
| 5,924,780 | A | 7/1999 | Ammon et al. | |
| 6,711,856 | B1 | 3/2004 | Hoffman | |
| 6,932,200 | B2 | 8/2005 | Booker et al. | |
| 6,953,233 | B2 * | 10/2005 | Lam et al. | 312/333 |
| 7,152,892 | B2 * | 12/2006 | Rechberg | 292/304 |
| 7,228,949 | B2 | 6/2007 | Namiki et al. | |
| 7,281,704 | B2 | 10/2007 | Salice | |
| 7,347,515 | B1 * | 3/2008 | Lu | 312/333 |
| 7,367,597 | B2 * | 5/2008 | Rechberg | 292/304 |
| 7,374,261 | B1 * | 5/2008 | Wang | 312/333 |
| 7,472,973 | B2 * | 1/2009 | Huang | 312/333 |
| 7,600,828 | B2 * | 10/2009 | Chen et al. | 312/333 |

(Continued)

FOREIGN PATENT DOCUMENTS

| | | |
|---|---|---|
| EP | 0777024 | 6/1997 |
| EP | 1555371 | 7/2005 |
| EP | 1584779 | 10/2005 |

OTHER PUBLICATIONS

International Search Report mailed Jun. 17, 2009.

(Continued)

*Primary Examiner* — Katherine Mitchell
*Assistant Examiner* — Justin Rephann
(74) *Attorney, Agent, or Firm* — Henry B. Ward, III; Moore & Van Allen PLLC

(57) ABSTRACT

The present invention relates to a method of operating a panel system including a moveable panel and an opening, the method characterised by the steps of aligning the panel with respect to the opening in an alignment plane so that the panel is capable of moving across the opening in the alignment plane, and positioning a panel release mechanism such that a user pushing on the panel along the alignment plane causes the panel release mechanism to release the panel from a fixed position within the panel system.

11 Claims, 4 Drawing Sheets

U.S. PATENT DOCUMENTS

| | | | | |
|---|---|---|---|---|
| 7,641,296 | B2 * | 1/2010 | Le | 312/333 |
| 7,960,924 | B2 * | 6/2011 | Fitz | 318/2 |
| 2002/0011766 | A1 * | 1/2002 | Kim et al. | 312/319.1 |
| 2006/0279186 | A1 * | 12/2006 | Lam et al. | 312/319.1 |
| 2008/0136300 | A1 * | 6/2008 | Wang | 312/319.1 |
| 2008/0169741 | A1 * | 7/2008 | Jurja | 312/319.1 |
| 2009/0033187 | A1 * | 2/2009 | Chung | 312/319.1 |
| 2009/0140621 | A1 * | 6/2009 | Yang | 312/319.1 |

OTHER PUBLICATIONS

International Preliminary Report mailed May 3, 2010.

* cited by examiner

PANEL MOVEMENT SYSTEM

TECHNICAL FIELD

This invention relates to a panel movement system.

BACKGROUND ART

In particular the present invention may be employed to assist in the closing of a cavity slider door.

In a fully open position, cavity slider doors are contained within a cavity pocket leaving the leading edge of the door flush with the door frame. They retain the functionality and benefits of a conventional sliding door over a traditional swinging door.

A sliding door requires less space to operate than a swinging door, particularly with regard to floor space of a room. They are safer to operate than swinging doors, which may require a person to step back in order to open them. Additionally, opening a door outwardly with a person on the opposite side may result in the door striking the other person. Sliding doors are generally more accessible due to their operation and allowance for wider doorways—ideal for persons using a wheelchair or walking frame.

Cavity slider doors expand on these advantages by retaining of the door within a cavity or pocket in the wall of a structure when open. This allows the doorway to be positioned closer to the side wall of a room if so desired, and with the door retained within the wall, more floor space is created. Additionally, with the door being within the confines of the wall the chance of inadvertently hitting or catching on the edge of the door while turning the corner is eliminated.

There is also an aesthetic advantage in retaining the door within a cavity. The lines of walls which would be broken by a sliding door and its associated running gear are sustained. Similarly, the door edge may be positioned such that it is flush with the door jamb—unobtrusive and providing continuity with the lines of the door frame.

In order to enable an operator to slide the door to its desired position across the doorway the door usually has a recessed handle in its side face which may be grasped. Unfortunately, when the door is fully retracted into the cavity pocket, the flush handles are hidden until the door has been pulled forward from its resting position by approximately 50 millimetres to 80 millimetres.

This initial release from the cavity pocket is usually achieved by pulling the door, employing one of two methods. Firstly, using a small lever which may be flicked up from the door edge of the handle. Secondly, a finger hole is made available, which is generally also part of the door handle itself.

The disadvantage of these methods is that they require a significant amount of structural material to be removed from the leading edge of the door in order to install and house such handles. This removal of material compromises the structural integrity of the door, and can lead to warping. In a cavity door system, or indeed any sliding door system the warping of the door can prevent the door from operating correctly, if at all. The aesthetic appeal of the door is also negatively impacted.

The aesthetic appeal of a cavity slider door lies in its non-obtrusive nature, particularly with those doors mounted flush with the door jamb. It is not desirable to have the door operating mechanism visible while the door is in an open position—ideally the door edge is unmarred by an attachment or hole.

Additionally, methods requiring a secondary handle to move the door sufficiently to grasp the main handles may not be practical for those with low dexterity or finger strength. Particularly, very young, elderly and disabled persons may not be able to operate the door using such methods.

Japanese Patent No. JP2001073630A2 discusses a device for aiding in the opening of a sliding door. When the door is pulled, it releases a catch—causing a spring loaded plunger to push against the door frame, intended to aid in gaining initial momentum for opening the door. This might be applied to the closing of the door also, however it still requires the pulling of the door from its initial resting place—which does not solve the problem at hand.

It would therefore be of advantage to have a method and apparatus which addressed any or all of the above problems. In particular, a method and apparatus for the release of a sliding door from its resting position without removing significant material from the door, or necessitating the grasping of the door to move it into such a position that side handles might be used would be of advantage.

It would also be advantageous if such an apparatus might be positioned out of sight, away from the leading edge of the door.

All references, including any patents or patent applications cited in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications are referred to herein, this reference does not constitute an admission that any of these documents form part of the common general knowledge in the art, in New Zealand or in any other country.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

It is an object of the present invention to address the foregoing problems or at least to provide the public with a useful choice.

Further aspects and advantages of the present invention will become apparent from the ensuing description which is given by way of example only.

DISCLOSURE OF INVENTION

According to one aspect of the present invention there is provided a method of operating a panel system including a moveable panel and an opening, the method characterised by the steps of:

a) aligning the panel with respect to the opening in an alignment plane so that the panel is capable of moving across the opening in the alignment plane, and b) positioning a panel release mechanism such that a user pushing on the panel along the alignment plane causes the panel release mechanism to release the panel.

According to another aspect of the present invention there is provided a panel release mechanism configured to operate in accordance with the above method.

According to another aspect of the present invention there is provided a panel system constructed to operate in accordance with the above method.

Reference to a panel throughout the specification should be understood to refer to any means suitable for the covering or uncovering of an opening in accordance with the present invention. This may include doors—both screen and solid, windows, hatches or vehicle wings. In many embodiments the panel will be substantially planar although this should not be seen as limiting. For example, the panel may be curved and travel along a curved plane.

In some embodiments the term panel could be construed as including joinery other than doors, for example, drawers, tables, cutting boards and the like.

Reference to movable throughout the specification should be understood to mean any translational motion of a panel along its plane. Those skilled in the art should appreciate that such a motion may be achieved through a variety of methods such as tracks, skids, rolling bearings, or suspension systems.

Reference shall now be made to the panel as being a door in a cavity slider door system throughout the specification, but this should not be seen as limiting as it may apply to many other movable panels including non-cavity slider doors.

A cavity slider door system should be understood to refer to a sliding door system whereby the door in its open position is substantially contained within a cavity. In a preferred embodiment, the system includes an opening, a door, a cavity, and a means which allows the door to be movable within the system.

Reference to a cavity throughout the specification should be understood to mean any space which substantially encloses the door of a cavity slider door system when the door is in an open position.

In preferred embodiments, the cavity is integrated into a wall so that the sides of the cavity are hidden from sight. However, those skilled in the art should recognise that the cavity may be a stand alone structure or construct. By way of example, the cavity may extend the length of a wall, rather than being within it.

Reference to an opening throughout the specification should be understood to mean any space that may be at least partially filled or blocked by a panel.

The preferred embodiment of an opening in the current invention is such that the space is of a complementary shape to the door. However, those skilled in the art should appreciate that the present invention may be used in conjunction with openings of differing dimensions or shapes to the door.

Alternatively, the opening may be the space into which the panel extends—such as the space filled by an open drawer or extended board.

Reference throughout the specification will be made to the alignment of a door with regard to the opening. This should be understood to refer to the arrangement of the components of the cavity slider door system such that they allow progression of the door between an open and closed position.

In a preferred embodiment, the open position of the door is such that the door is fully retained within the cavity with the leading edge of the door flush with the door jamb.

The preferred embodiment of alignment in the current invention is the arrangement of an opening directly in line with the cavity of a cavity slider door system and a door positioned such that it may move directly between the cavity and the opening.

In a preferred embodiment the panel or door release mechanism is positioned in such a way that the mechanism acts against a bearing surface in line with the plane of the door. In a further preferred embodiment, the door release mechanism is positioned on the back edge of the door while the bearing surface is at the end of the cavity.

However, those skilled in the art should appreciate that the door release mechanism may be positioned in any location such that the user pushing on the door causes the door release mechanism to release the door. For example, the door release mechanism may be located at the end of the cavity, while the bearing surface is on the back edge of the door.

Reference to a bearing surface throughout the specification should be understood to refer to any surface of any orientation which is capable of resisting loading. In a preferred embodiment, the bearing surface is an aluminium plate. However, those skilled in the art should recognise that the bearing surface may be formed of any number of materials such as steel, wood, plastic, rubber or indeed the door or end of the cavity themselves, without additional material.

The door release mechanism may be located at any point along the height of the door. Ideally, the door release mechanism will be located at the centre of the door's height. This maintains the balance of the door's weight, and ensures the most efficient transfer of energy from the door release mechanism to the door.

If the door release mechanism is off centre, energy may be lost in the resulting rotational motion around the door's centre of gravity during the release of the door. However, this should not be seen as limiting—the door release mechanism may still operate at any point along the height of the door.

In another embodiment more than one door release mechanism may be used. The location of the door release mechanisms along the height of the door is ideally evenly spaced relative to the centre. Again, this is to retain the balance of the door, and ensure the balanced application of force to the door during its release. The use of more than one door release mechanism may be to facilitate this balanced application of force, or to aid in the release of an oversized door which requires greater force to be moved into a position such that the user is enabled to readily pull the door into the opening.

The door release mechanism can come in a variety of forms. Preferably the door release mechanism is configured such that when it releases the door, the door moves to a position such that the user is enabled to readily pull the door into the opening.

It is therefore envisaged that the door release mechanism will include a biasing mechanism that acts to move the door back towards the user once the user has pushed the door in order to release the door.

Reference shall now be made to the biasing mechanism as a spring throughout the specification, but this should not be seen as limiting, as those skilled in the art should recognise that biasing may be achieved through various other means such as rubber, pneumatic struts or opposing magnetic fields.

It is envisaged that the loading of spring is achieved by pushing the door towards or into the cavity. In a preferred embodiment, the spring achieves maximum bias by pushing the door 10 mm past the door jamb.

Cavity slider door systems typically have a distance of approximately 10-12 mm between the back edge of the door and back of the cavity when the leading edge of the door is flush with the door jamb. This space allows for the inclusion of a rubber stop, to prevent damage to the system caused by the door striking the end of the cavity. In order that the method and apparatus be utilised using typical componentry, consideration of this distance is important.

However, it should be apparent to someone skilled in the art that this is by way of example only, and that there are a number of ways by which the spring may be configured to store enough energy to enable the door release mechanism to move the door to a position such that the user is enabled to readily pull the door into the opening.

It is envisaged that a translation member will be provided for transferring energy from the spring to the bearing surface. In a preferred embodiment, the translation member is in the form of a plunger. However, a person skilled in the art should recognise that any number of mechanisms may be used to transfer this energy, such as a stream of compressed air.

It is also conceivable that no translation member is utilised, and that the spring may transfer energy directly to the bearing surface.

In a preferred embodiment, the action of the spring is controlled by a control mechanism. It is envisaged that this control mechanism will guide the spring to a first loaded position through the user pushing the panel. The control mechanism further provides means for allowing the spring to be released from that loaded position by the user pushing the panel a second time.

In a preferred embodiment, the control mechanism is in the form of a guidance mechanism in combination with a locating mechanism.

Reference to a guidance mechanism throughout this specification should be understood to refer to any means of providing guidance for a locating mechanism in order to control the travel, and release of the spring. In a preferred embodiment, the guidance mechanism is a cylinder with a path on its surface, along which the locating mechanism can travel.

Those skilled in the art will appreciate that alternative embodiments may include a flat guidance mechanism with a planar path on its surface.

Reference to a locating mechanism throughout this specification should be understood mean a component that is configured to interact with the path on the guidance mechanism to ensure the travel and release of the spring occurs as desired.

It is envisaged that in order for the door release mechanism to operate in accordance with the method described by the present invention the guidance mechanism will include a series of points from which the locating mechanism cannot retreat.

For example, the locating mechanism is initially located at a first position on the guidance mechanism. When the spring is fully biased by the user pushing on the door in order to close the door—the locating mechanism reaches a second point on the guidance mechanism. When the user stops pushing the door, the bias of the spring moves the locating mechanism along the guidance mechanism to a third point such that the spring is substantially compressed and the leading door edge is flush with the door jamb.

The locating mechanism maintains the bias of the spring at this third point until the user initiates the release of the door by pushing on the door again. At this time the spring is fully biased again, with the location mechanism arriving at a fourth position. When the user stops pushing the door, the spring causes the locating mechanism to arrive back at the first position, ready for the next operating cycle.

The transfer of the locating mechanism from the fourth position to the first position corresponds to the spring causing the translation member to act against the bearing surface, releasing the door.

In a preferred embodiment the guidance mechanism is formed from acetyl plastics material. This allows for a reduction in noise when the locating mechanism contacts the guidance mechanism, especially when compared with embodiments formed of metal. Material properties also allow for reduced friction between the guidance mechanism and locating mechanism—reducing wear and tear as a result.

Given that it is envisaged that the door release mechanism is positioned on the back edge of the door, repairs or replacement may be difficult once the door has been installed into the cavity slider door system. This reduction in the wear of the door release mechanism is therefore an important consideration.

However, those skilled in the art will appreciate that this is by way of example only, and not intended to be limiting. The guidance mechanism may be formed from any suitable material such as other plastics, wood, ceramics or metal.

In a preferred embodiment the locating mechanism is in the form of a pin. It is envisaged that this pin is positioned perpendicular to the surface of the scroll, and projects into the path provided by the guidance mechanism.

In a preferred embodiment the translation member includes a shaft on which the cylindrical guidance mechanism is located, such that the guidance mechanism may freely rotate axially around the shaft.

It is envisaged that the guidance mechanism will be held in place relative to the length of the shaft by a retainer cap. Preferably the retainer cap is naturally held in place by the bias of the spring. In doing so, the guidance mechanism may be held in place without requiring machining of the retainer cap or shaft to provide a locking means such as a thread. This results in lower labour and machining costs when manufacturing the panel release mechanism.

However, it should be appreciated that any method known to one skilled in the art for holding the guidance mechanism in place may be implemented without departing from the present invention.

Care needs to be taken to ensure that the power, size and travel of the door release mechanism are such that it provides sufficient force to release a range of doors to a desired extent while remaining operable by a variety of users.

By way of example, cavity slider doors may be hollow or solid in construction, creating a variation in weight between doors of the same dimensions. Additionally, the dimensions of the door may differ from standard sizing, creating further variations in weight between doors.

It is envisaged that the specification of the spring will be such that it allows for a single configuration of the door release mechanism to operate in the method described by the current invention, for a range of door sizes and weights.

However, those skilled in the art should recognise that this is not intended to be limiting, and the door release mechanism may be customised to account for these differences.

It is envisaged that the door release mechanism will include a mechanism for holding the door away from the opening. Reference to holding throughout the specification should be understood to refer to the retaining of the door at a predetermined position at any point in or between the opening and cavity.

Those skilled in the art should appreciate that such a retention may be achieved through a variety of methods such as magnets, clasps, adhesives, clips, clamps, catches, fastenings or hooks, and may operate independently of the panel release mechanism.

The present invention has a number of advantages over the prior art, namely:

- By eliminating the need for secondary handles, the aesthetic lines of a cavity slider door system are enhanced,
- The structural integrity of a panel system is improved, increasing longevity and eliminating or offsetting costs in replacing repairing the panel,
- Users can readily close panel systems without requiring handles which are difficult to grasp.

BRIEF DESCRIPTION OF DRAWINGS

Further aspects of the present invention will become apparent from the following description which is given by way of example only and with reference to the accompanying drawings in which.

BEST MODES FOR CARRYING OUT THE INVENTION

Figure 1:
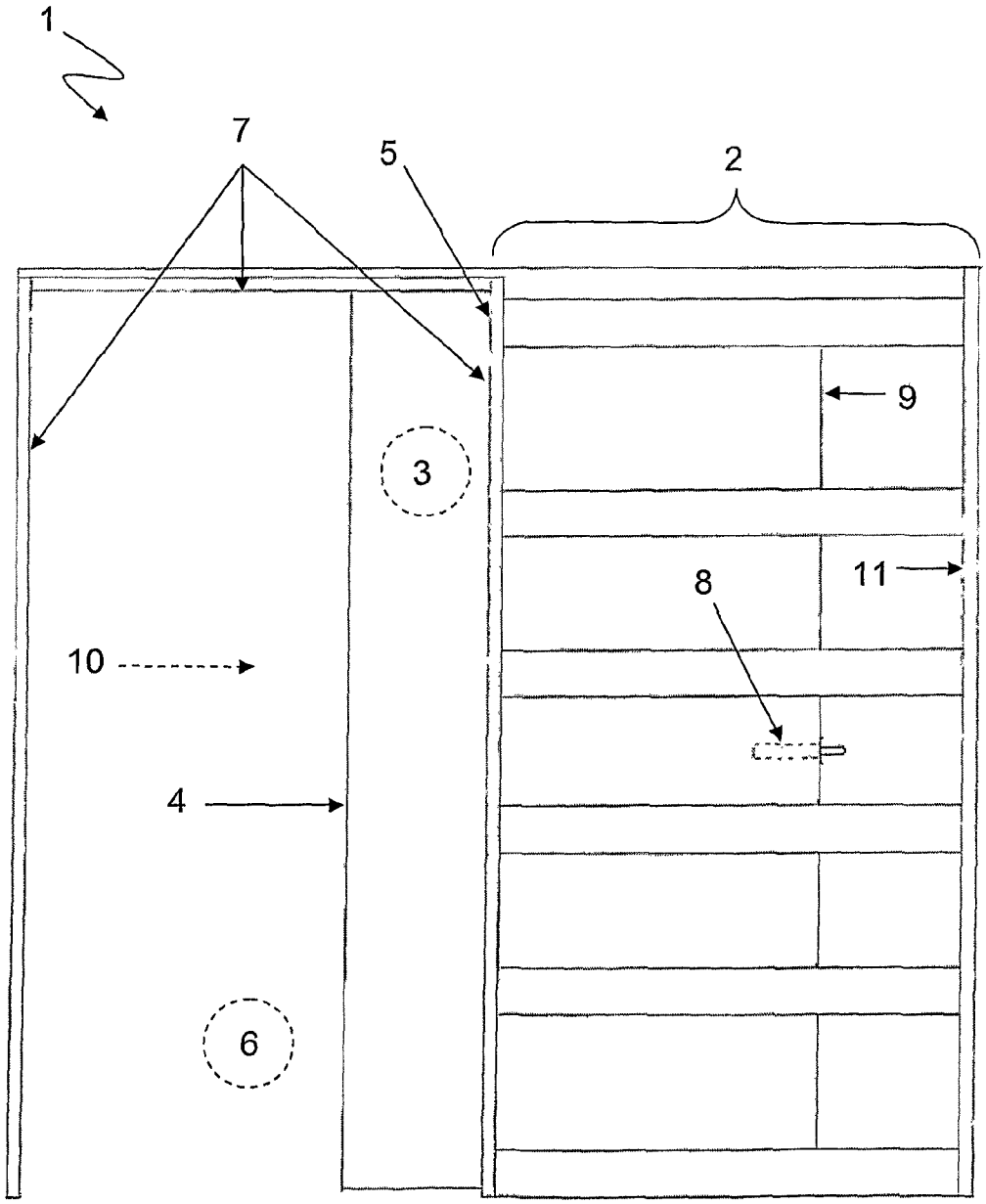
FIG. 1 illustrates a panel system in a preferred embodiment.

FIG. 1 illustrates a panel system (generally indicated by arrow 1) in a preferred embodiment.

The panel system (1) includes a cavity which is provided in this embodiment by a pocket (2) (not clearly shown).

The pocket (2) is configured to receive a sliding door (3).

In one position the door (3) is completely enclosed by the pocket (2) such that the leading edge (4) of the door (3) is flush with the door jamb (5).

The sliding door (3) can transition between the pocket (2) and an opening or doorway (6).

The doorway (6) is bounded by a door frame (7).

A panel release mechanism (8) is positioned centrally on the back edge (9) of the door (3).

The operation of the panel system (1) works as follows.

To hold the door (3) open, the user pushes the door (3) in the direction indicated by arrow (10).

The user continues to push the door (3) until the panel release mechanism (8) is fully actuated against a bearing surface (11), provided in this embodiment by the end of the pocket (2).

The user then discontinues pushing the door (3), as it is fully open and enabled to be held into position.

The panel release mechanism (8) will then move the door (3) so that its leading edge (4) is flush with the door jamb (5).

In order to release the door (3), the user pushes the door (3) in the direction indicated by arrow (10) until it can be pushed no further.

The user then discontinues pushing the sliding door (3).

The panel release mechanism (8) then releases the sliding door (3) from the pocket (2) to a point where the user can pull the door (3) to its desired position.

Figure 2A:
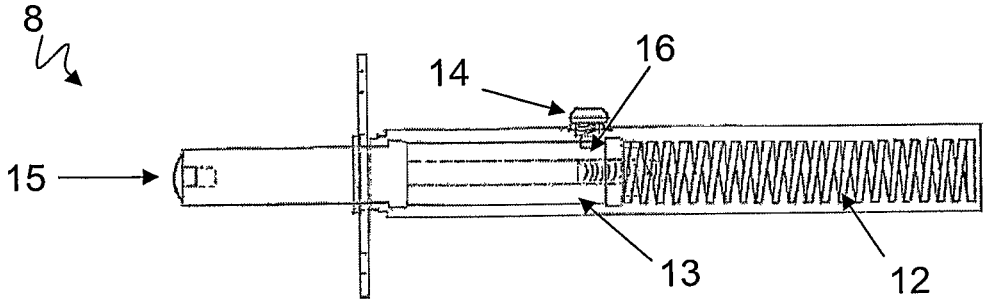
FIGS. 2*a*, 2*b*, 2*c* illustrate a panel release mechanism in accordance with a preferred embodiment.
Figure 2B:
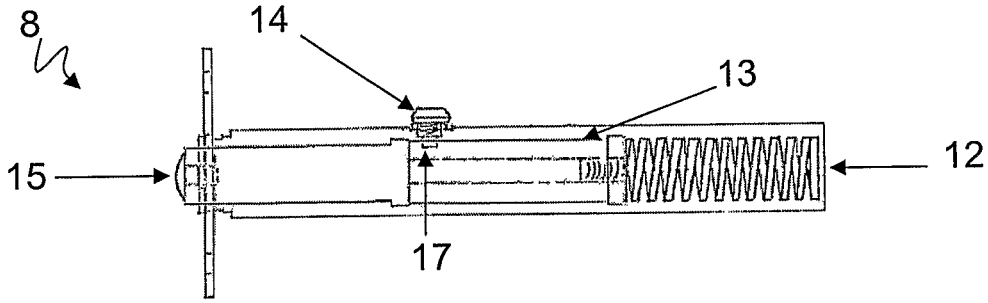

FIGS. 2*a* and 2*b* illustrate a panel release mechanism in accordance with a preferred embodiment.

The panel release mechanism (8) includes a biasing mechanism which is provided in this embodiment by a spring (12).

The spring (12) is configured to be controlled by a guidance mechanism in the form of a scroll (13), in conjunction with a locating mechanism in the form of a pin (14).

The panel release mechanism (8) further includes a translation member in the form of a plunger (15).

The plunger (15) acts to transfer energy from the spring (12) to a bearing surface (11)—at the end of the pocket (2).

FIG. 2*a* shows the panel release mechanism (8) in its released state, with the pin (14) at a first position (16) (not clearly shown) on the scroll (13).

FIG. 2*b* shows the panel release mechanism (8) in a fully actuated state, with the pin (14) at a second position (17) (not clearly shown) on the scroll (13).

Figure 2C:
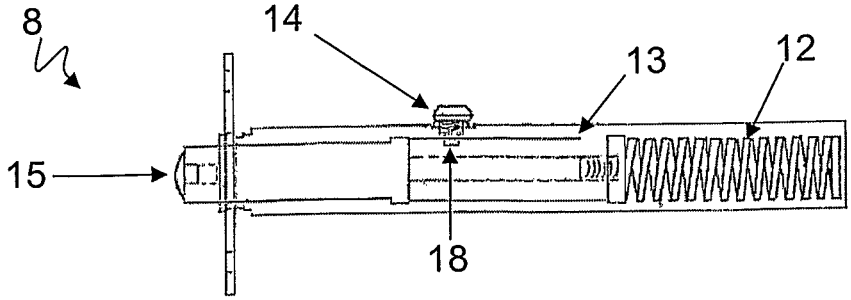

FIG. 2*c* shows the panel release mechanism (8) in a ready state, with the pin (14) at a third position (18) (not clearly shown) on the scroll (13).

Figure 3A:
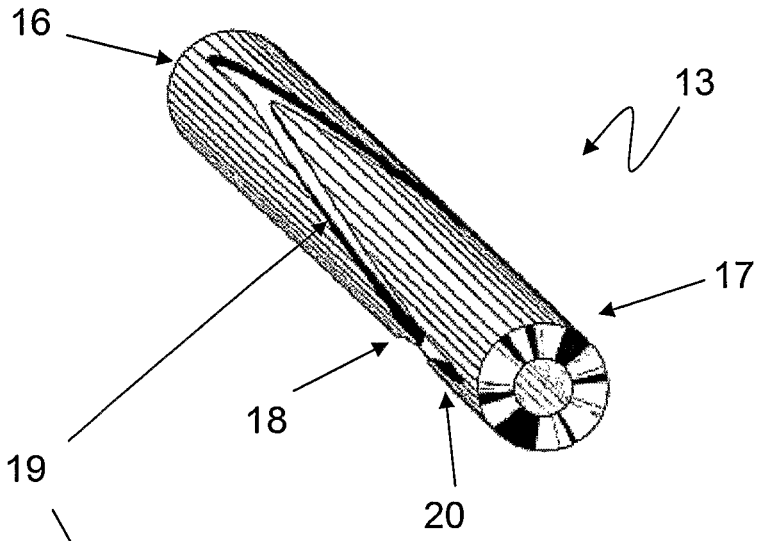
FIGS. 3*a*, 3*b* illustrate a guidance mechanism in accordance with a preferred embodiment.
Figure 3B:
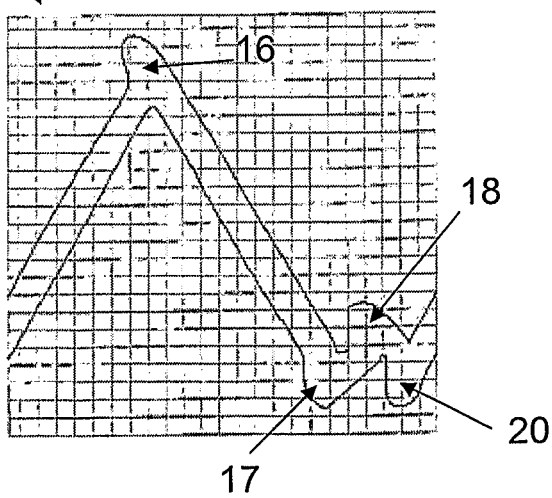

FIGS. 3*a* and 3*b* illustrate a guidance mechanism in accordance with a preferred embodiment.

The guidance mechanism (13) in the form of a scroll includes a path (19) (not clearly shown on FIG. 3*a*).

The pin (14) projects into the path (19).

As the user pushes the door (3), the panel release mechanism (8) transitions from its released state to a fully actuated state. This corresponds to movement of the scroll (13) such that the pin (14) transitions from the first position (16) to the second position (17).

The user then discontinues pushing the door (3), the panel release mechanism (8) will then transition to a ready state, moving the door (3) so that its leading edge (4) is flush with the door jamb (5). This corresponds to movement of the scroll (13) such that the pin (14) transitions from the second position (17) to a third position (18).

In order to release the door (3), the user pushes the door (3) in the direction indicated by arrow (10) until it can be pushed no further, so that the panel release mechanism is in another fully actuated state. This corresponds to movement of the scroll (13) such that the pin (14) transitions from the third position (18) to a fourth position (20).

The user then discontinues pushing the sliding door (3).

The panel release mechanism (8) then releases the sliding door (3) from the pocket (2) to a point where the user can pull the door (3) to its desired position. This corresponds to movement of the scroll (13) such that the pin (14) transitions from the fourth position (20) to the first position (16).

Figure 4:
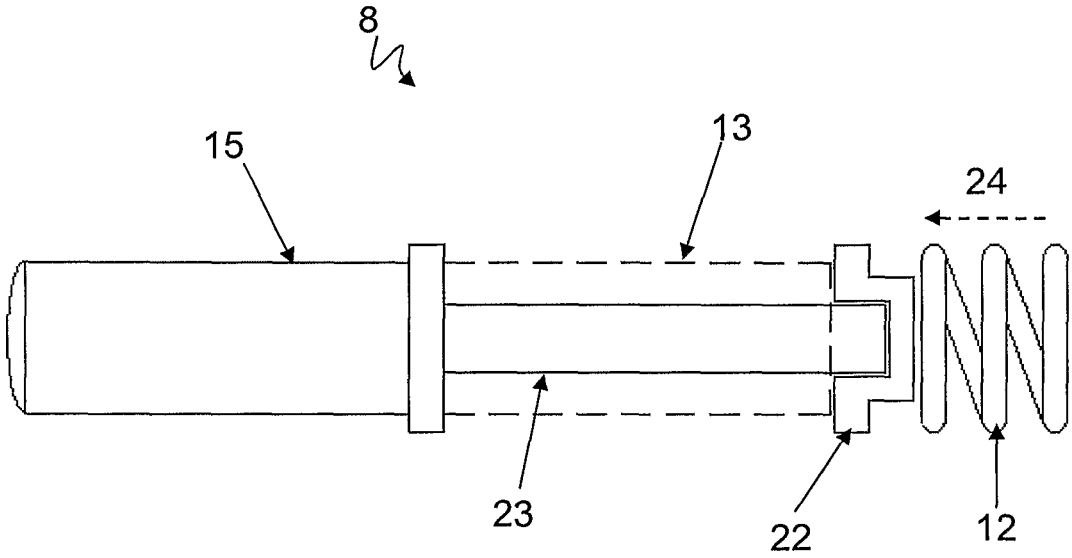
FIG. 4 illustrates a further aspect of the panel release mechanism in accordance with a preferred embodiment.

FIG. 4 illustrates a further aspect of the panel release mechanism (8).

The plunger (15) is connected to a shaft (21). The shaft (21) is configured to be inserted through the scroll (13), such that the scroll (13) may freely rotate axially, in accordance with the operation described with regard to FIGS. 2 and 3.

The panel release mechanism (8) includes a retainer cap (22). The retainer cap is configured to fit over the end of the shaft (21), to prevent the scroll (13) from sliding off the shaft (21).

The retainer cap (22) is naturally held in place by the spring (12), which is biased in the direction indicated by arrow (23).

By utilising the natural action of the spring (12), the retainer cap (22) does not require a separate locking mechanism such as a screw thread to maintain its position and hold the scroll (13) in place. This reduces labour and machining costs in manufacturing, and also reduces assembly time by eliminating the additional step of fastening the retainer cap (22) to the shaft (21).

Aspects of the present invention have been described by way of example only and it should be appreciated that modifications and additions may be made thereto without departing from the scope thereof as defined in the appended claims.

What I claim is:

1. A panel release mechanism configured to release a moveable panel from an open position within a panel system, the panel release mechanism comprising:

a housing;

a translation member configured to be moved between a released position and a loaded position;

a biasing mechanism configured to bias the translation member towards the released position;

a control mechanism configured to control movement of the translation member, comprising a locating mechanism and a guidance mechanism, wherein the guidance mechanism comprises a path which interacts with the locating mechanism to define the travel and release of the biasing mechanism, which indirectly or directly causes the panel to be released from the open position, and wherein either the locating mechanism or the guidance mechanism is configured to remain in a fixed position relative to the housing while the guidance mechanism or the locating mechanism respectively rotates and travels within the housing in order to control the movement of the translation member.

2. The panel release mechanism as claimed in claim 1 wherein the path comprises a series of positions from which the locating mechanism can only move in one direction along the path.

3. The panel release mechanism as claimed in claim 1 configured to maintain a substantially biased condition of the biasing mechanism until released by a user.

4. The panel release mechanism as claimed in claim 1, wherein the translation member is configured to be moved from the released position to the loaded position by a user pushing against the bias of the biasing mechanism.

5. The panel release mechanism as claimed in claim 4, wherein the translation member is configured to be subsequently released from the loaded position by the user pushing against the bias of the biasing mechanism.

6. A method of operating a panel system comprising a moveable panel, an opening, and a panel release mechanism as claimed in claim 1, the method comprising the steps of:

a) aligning the panel with respect to the opening in an alignment plane so that the panel is capable of moving across the opening in the alignment plane, and b) positioning the panel release mechanism such that a user pushing on the panel along the alignment plane causes the panel release mechanism to release the panel from an open position within the panel system.

7. A method as claimed in claim 6 wherein the panel is a door.

8. A method as claimed in claim 6 wherein the panel system is a cavity slider door system.

9. A method as claimed in claim 6 wherein releasing the panel moves the panel across the opening sufficiently for the user to grasp the panel and pull it fully across the opening.

10. A method as claimed in claim 6 wherein the panel is substantially contained within a cavity before being released by the panel release mechanism.

11. A method as claimed in claim 6 wherein the panel release mechanism is positioned on an edge of the panel facing away from the opening.

* * * * *